United States Patent [19]

Tanaka

[11] 4,144,018

[45] Mar. 13, 1979

[54] CIGARETTE LIGHTER USING HYPERGOLIC FUEL COMPONENT

[75] Inventor: Noboru Tanaka, Tokyo, Japan

[73] Assignees: Tokyo Pipe Co. Ltd.; Dankyo Seisakusho Co., Ltd., both of Tokyo, Japan

[21] Appl. No.: 828,636

[22] Filed: Aug. 29, 1977

[30] Foreign Application Priority Data

| | | | |
|---|---|---|---|
| Sep. 11, 1976 | [JP] | Japan | 51-109196 |
| Sep. 14, 1976 | [JP] | Japan | 51-110424 |
| Sep. 20, 1976 | [JP] | Japan | 51-112690 |

[51] Int. Cl.[2] ..... F23Q 2/16

[52] U.S. Cl. ..... 431/131; 431/150; 431/267; 431/268

[58] Field of Search ..... 431/130, 131, 150, 267, 431/268

[56] References Cited

U.S. PATENT DOCUMENTS

| | | | |
|---|---|---|---|
| 3,085,411 | 4/1963 | Daugherty | 431/267 |
| 3,299,675 | 1/1967 | Laffitte et al. | 431/268 |
| 3,360,965 | 1/1968 | Spreter et al. | 431/267 |
| 3,879,163 | 4/1975 | Wright | 431/267 |

*Primary Examiner*—Carroll B. Dority, Jr.

*Attorney, Agent, or Firm*—Eyre, Mann, Lucas & Just

[57] ABSTRACT

A hypergolic substance which is spontaneously ignited upon being exposed to the atmosphere ignites the fuel issuing from the nozzle of a cigarette lighter. The hypergolic substance is either mixed with the fuel in a fuel tank or is separately contained within the lighter body. Dispensing of at least the hypergolic substance is controlled by a positive and conscious physical act of the user employing a lever mounted within the lighter body or direct finger pressure on a valve. A mechanical interlock additionally prevents accidental or casual release of the hypergolic substance. The mechanical interlock holds the lever or valve immobile until the cap is opened.

7 Claims, 6 Drawing Figures

CIGARETTE LIGHTER USING HYPERGOLIC FUEL COMPONENT

BACKGROUND OF THE INVENTION

In cigarette lighters, it has long been known to use a flint, electric resistance heater or spark discharge, or external heat to ignite a fuel. Additionally, it is also known to use a self-burning gas, which ignites on contact with air, or a chemical catalyst which heats by reaction with a fuel gas and thus ignites the gas. Ignition methods which use neither electric spark discharge nor resistance heater are very convenient since nothing but fuel is required for their operation.

In the case of the self-burning or hypergolic gas, however, great care must be exercised to prevent leaks since spontaneous ignition of the gas upon exposure to the atmosphere can create a safety hazard. In the case of a lighter ignited by a catalyst, space must be provided for the chemical substance providing the reaction with the catalyst. The resulting extra volume is contrary to the desired small size of a pocket cigarette lighter.

SUMMARY OF THE INVENTION

The present invention teaches a cigarette lighter in which a self-burning substance, preferably a gas or a liquid having a vapor pressure greater than one atmosphere, capable of being instantaneously ignited upon exposure to the atmosphere, is contained within a reservoir in the lighter body. The self-burning substance is controlled by a button operation under positive control of the user. The button is mechanically interlocked into an immovable state when not in operation. An openable cap, when opened, releases the mechanical interlock and enables operation of the lighter.

The self-burning gas is used as means for igniting the main fuel. It is supplied by a constant quantity valve which positively limits the quantity of material delivered with each actuation to a fixed amount in order to prevent ignition inside the nozzle. Delivery of the fixed amount of self-burning gas is accomplished by opening the cap and operating an operating button accessible from the outside. When the fixed amount of self-burning gas is delivered, operation of the operating button is ineffective to deliver more until the operating button is released and then reactuated. Thus operation of the lighter requires the positive physical acts of the user and reduces the likelihood of unintentional operation of the operating button either by the user or of accidental operation by external shock when the lighter is being carried or stored. These features permit safe use of a convenient lighter ignited by self-burning gas.

In a first embodiment of the invention, the self-burning gas and the fuel are contained in the lighter mixed together in a single fuel tank. When the lighter is operated, a fixed quantity of fuel containing the self-burning gas is made available for delivery to a nozzle. As the mixture meets the atmosphere upon leaving the nozzle, the self-burning gas in the mixture kindles the fuel. The resulting flame continues either until the fixed quantity of fuel is exhausted or until the operating lever is released. In a second embodiment of the invention, the fuel and self-burning gas are stored in separate containers. When the cap is opened and the operating lever pressed a fixed quantity of self-burning gas is dispensed from a first nozzle adjacent to a second nozzle connected to the fuel tank. The fixed quantity of self-burning gas ignites the fuel which continues to issue as long as the operating lever is pressed. In a third embodiment of the invention, a fuel and self-burning gas are separately contained in a pencil-type lighter. When the cap of the pencil-type lighter is removed, a valve in the fuel nozzle is released. Fuel begins issuing from the nozzle. Finger pressure on a button delivers a fixed quantity of self-burning gas into a pan located near the fuel nozzle outlet. The self-burning gas ignites the fuel at the nozzle. The fuel continues to issue from the fuel nozzle until the removable cap is replaced.

Any storeable gasifiable fuel such as butane or propane may be used. Any storeable self-burning gas such as trimethyl aluminum or trimethyl boron may be used.

DETAILED DESCRIPTION OF THE PREFERRED EMBODIMENT

In the cigarette lighter according to the invention, a self-burning substance which is spontaneously ignited upon exposure to the atmosphere is provided as the means for igniting the main fuel gas. Dispensing of the self-burning substance externally controlled by an operating button accessible from the surface of the lighter body requiring a positive physical act of the user. To ensure reliable preservation of the self-burning substance when the lighter is not in use and also prevent casual external operation by the user, the operating button is held immovable by a mechanical interlock attached to the cap when the cap is closed. In the first and second embodiments, the cap is hinged to the body and must be fully opened before the operating button can be moved. In the third embodiment, the operating button is covered by a removable cap which must be fully removed to obtain access thereto.

Figure 1:
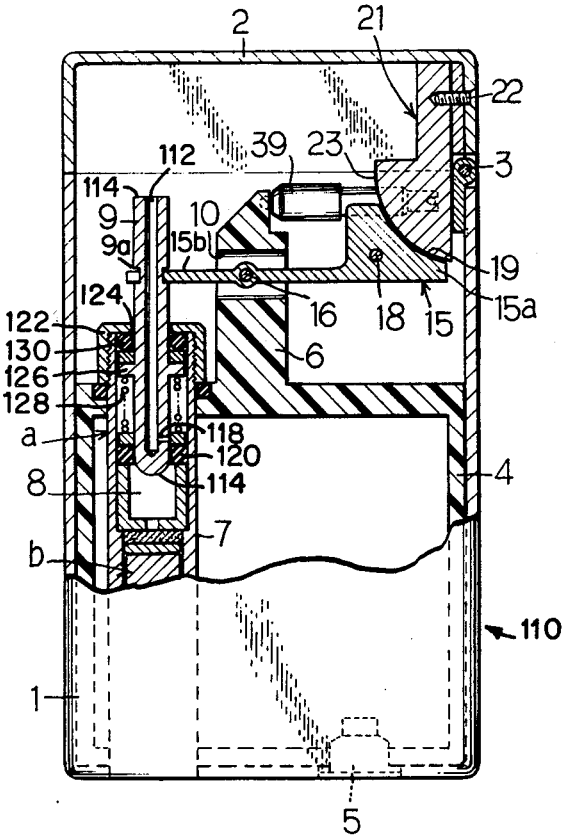
FIG. 1 is a fragmentary sectional view showing a first embodiment of the invention.

Referring now to FIG. 1, there is shown a lighter 110 having a case 1 with a cap 2. The cap 2 is hinged to the case 1 by a hinge pin 3. A fuel tank 4 is located in the lower portion of the case 1 and is provided at the bottom with a filler opening 5 for filling with fuel. An upright projection 6 extends upward above the fuel tank 4. The fuel tank 4 is filled with a mixture of fuel and self-burning material. Thus when the mixture comes in contact with the atmosphere, it ignites spontaneously.

A gas control chamber 7 through the case 1 contains a constant quantity valve a and a regulator b for regulating the quantity of gas delivered at each operation. The gas is led through a gas passage (not shown) within the fuel tank 4 to gas control chamber 7. A fixed quantity of gas is supplied by the quantity regulator b to a constant quantity chamber 8. Gas is supplied from the constant quantity chamber 8 to a nozzle 9 as will be explained.

A lateral hole 10 through the upright projection 6 accommodates the actuating end **15*b* of lever 15. A pivot pin 16 through the lever 15 provides the fulcrum about which the lever 15 may rotate. The actuating end 15***b* engages a groove 9*a* in nozzle 9.

An interlock portion 15*a* on the lever 15 has a concave arcuate surface 19 which interferes with a convex arcuate surface 23 on an interlock member 21 attached to, and rotatable with, the cap 2. The interlock member 21 is attached to the cap by any convenient means such as welding, cementing, staking, rivets, or one or more screws 22 as shown in FIG. 1.

An extensible opening and closing rod 39 is hingedly attached at its ends to the top of the upright projection 6 and in a groove in the interlock member 21. The opening and closing rod 39 aids in providing smooth opening and closing of the cap 2, as is well known in the art.

Figure 2:
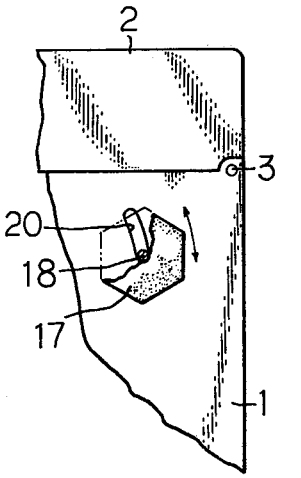
FIG. 2 is a fragmentary side view of the lighter showing the movement of an operating button on the outer surface of the lighter.

Referring now also to FIG. 2, an external operating button 17 is disposed outside the case 1. A pin 18 is fixedly connected to the operating button 17 and passes through an arcuate slot 20 in the interior of the case 1 where it is fixedly connected to the lever 15. The double-headed arrow in FIG. 2 shows the motion of the operations button 17.

The nozzle 9 contains a channel 112 which is open at the top 114 but closed at the bottom 114. A lateral channel 118 communicates through the side wall of the nozzle 9 near the bottom 116. A resilient annular seal 120 sealingly engages the top of the constant quantity chamber 8 and the perimeter of the bottom 116 of the nozzle 9. In the inoperative position shown, the lateral channel 118 is above the annular seal 120 and thus the constant quantity chamber 8 is isolated from channel 112. A cap 122 closes the top of the gas control chamber 7. A hole 124 permits passage of the nozzle 9 therethrough. An annular projection 126 on the nozzle 9 provides a bearing surface for a bias spring 128 which tends to urge the nozzle 9 upward into the sealed position. A resilient seal 130 between the annular projection 126 and the inside of the cap 122 sealingly engages the perimeter of the nozzle 9. The resilient seal 130 prevents leakage of residual gas alongside the nozzle 9 through hole 124.

Figure 3:
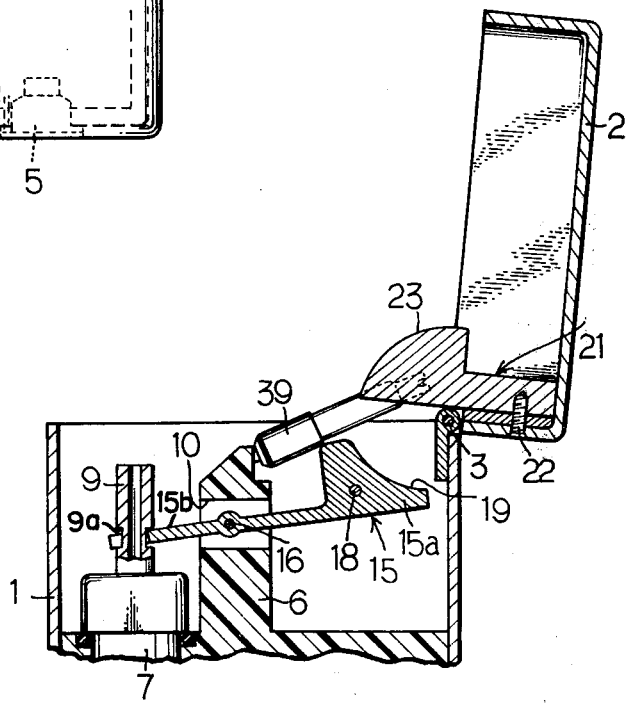
FIG. 3 is a fragmentary sectional view of the first embodiment showing the mechanical interlock with the cap open.

Referring now also to FIG. 3, the cap 2 has been raised, thus disengaging arcuate surfaces 19 and 23. The operating button 17 has been pushed to its upper position thus lowering the actuating end 15*b* of the lever 15. The nozzle 9 is pushed downward into the gas control chamber 7 by the engagement of the actuating end 15*b* with groove 9*a* in nozzle 9. The depressing of the nozzle 9 moves the lateral channel 118 through the annular seal 120 and into fluid communication with constant quantity chamber 8. The fluid in constant quantity chamber 8 is thus enabled to pass through lateral channel 118 and channel 112 to the atmosphere where it spontaneously ignites. The resulting flame continues either until the fuel in constant quantity chamber 8 is exhausted or until the operating button 17 is released. When operating button 17 is released, bias spring 128 returns the nozzle 9 and operating button 17 to the off position.

Figure 4:
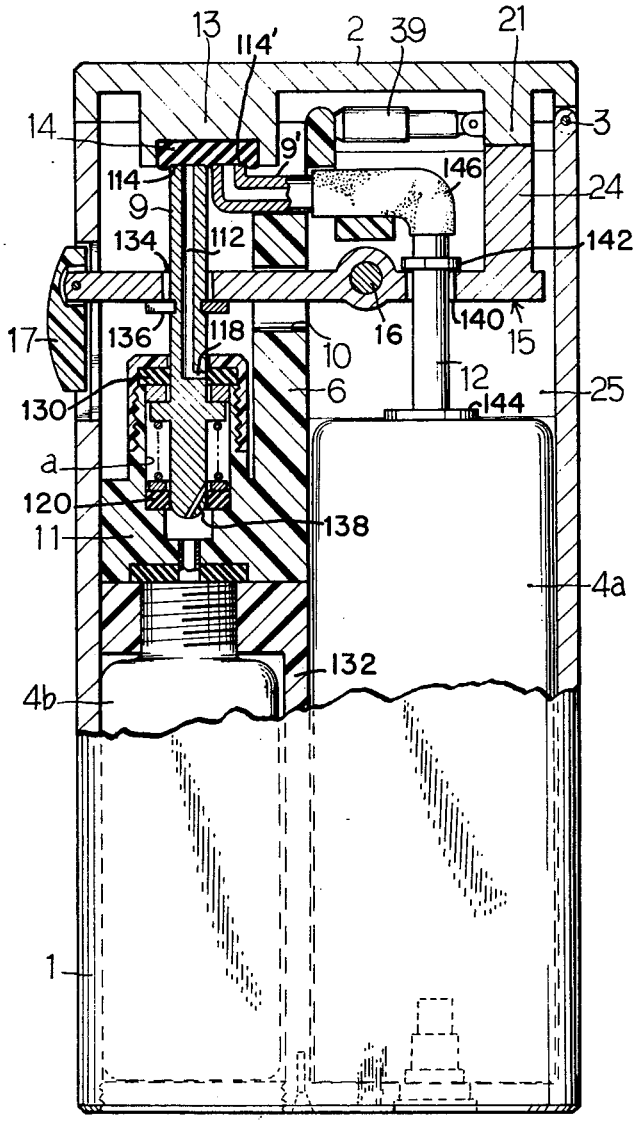
FIG. 4 is a fragmentary sectional view showing a second embodiment of the invention.

Turning now to the second embodiment of the invention shown in FIG. 4, a fuel tank 4*a* and an igniter tank 4*b* are contained in the case 1 and separated by a septum 132. Two nozzles, igniter nozzle 9 and fuel nozzle 9' are disposed side by side. A resilient seal 14 connected to the cap 2 sealingly abuts the top 114 of the igniter nozzle 9 and the top 114' of the fuel nozzle 9' when the cap 2 is closed. The mechanical interlock in this embodiment is formed by a boss 24 on the lever 15 which interferes with an interlock member 21 on the cap 2.

The operating button 17 is directly connected to the end of the lever 15. The nozzle 9 passes through an oversize opening 134 in the operating lever 19. A circlip 136 or other protuberance on the nozzle 9 enables placing downward force on the nozzle 9 when the lever 15 is operated. The lateral channel 118 is sealingly enclosed by the seal 130 in the inoperative position shown in FIG. 4. A diagonal channel 138 bypasses the annular seal 120 to provide free fluid communication from the igniter tank 4*b* to the constant quantity valve a in the inoperative position.

A second oversize opening 140 through the lever 18 provides clearance for a tube 12 from the fuel tank 4*a*. A protuberance 142 on the tube 12 enables placing upward force on the tube 12 when the lever 15 is rotated to the operative position. A valve 144 supplies fuel to the tube 12 when the tube 12 is moved to its upper position by the lever 15. A flexible tube 146 connects the tube 12 to the fuel nozzle 9'.

When the cap 2 is opened and the operating button 17 moved downward, the nozzle 9 is moved downward, and the fuel nozzle 9' is raised. The diagonal channel 138 is moved downward until it is sealed by annular seal 120. No additional igniter material is able to reach the constant quantity valve a while the nozzle 9 is thus depressed. Simultaneously, the lateral channel 118 is moved downward out of sealing engagement with seal 130 and into open fluid communication with the igniter material in the constant quantity valve a. The igniter material isolated in the constant quantity valve a is enabled to pass through the lateral channel 118 and the channel 112 to the top 114 of the nozzle 9 where it ignites spontaneously on contact with the air. Simultaneously, the raising of tube 12 causes fuel to flow through fuel nozzle 9'. The existence of the spontaneously burning igniter material at nozzle 9 ignites the fuel at nozzle 9'. After a short time, the igniter fluid isolated in constant quantity valve a is exhausted. The flame from fuel nozzle 9' then continues until the operating button 17 is released.

Figure 5:
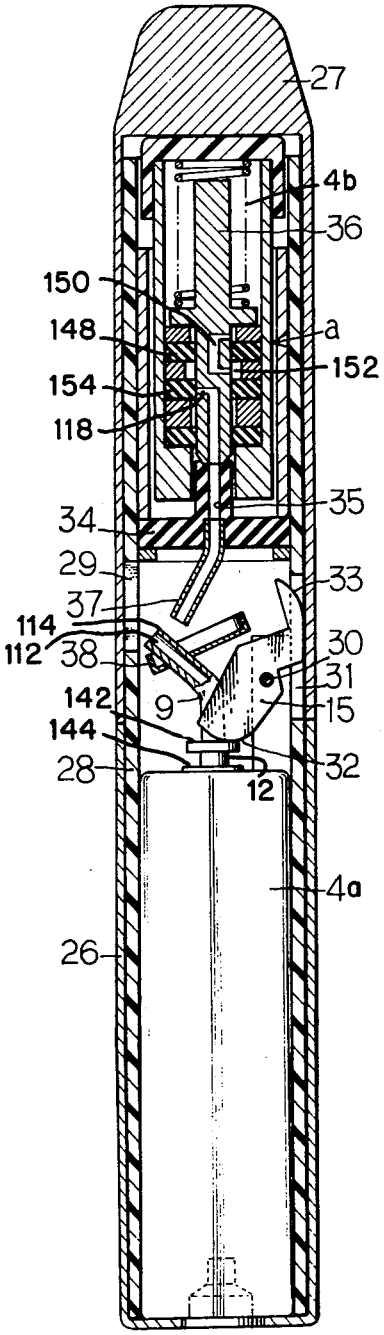
FIG. 5 is a fragmentary sectional view showing a third embodiment of the invention.

Referring now to FIG. 5, there is shown a third embodiment of the invention in the shape generally known as a pencil lighter. An inner container 28, in a generally elongated cylindrical shape, contains a fuel tank 4*a* in one end and an igniter tank 4*b* in its other end. A decorative outer sheath 26 permanently covers the lower portion of the inner container 28. A removeable cap 27 covers the remainder of the inner container 28.

The nozzle 9 is axially disposed with respect to the fuel tank 4*a* and its upper end is bent outward at an angle to redirect the channel 112 toward a window 29 in the inner container 28.

An actuator window 31 is located in the inner container 28. The actuating portion 33 of the lever 15 passes through the actuator window 31 and presses against the inside of the removeable cap 27. The lever 15, hinged on pin 30, is held rotated into its fully counterclockwise position in the closed position shown. A cam portion 32 on the lever 15 presses downward on the protuberance 142 thus forcing tube 12 downward into the fuel tank 4*a* and cutting off valve 144.

The constant quantity valve a employs an upper annular seal 148 and a U-shaped channel 150 to bypass the upper annular seal 148 in a shaft 36. The U-shaped channel 150 allows igniter fluid to enter an annular chamber 152 defined by the upper annular seal 148 and an intermediate annular seal 154. The lateral channel 118 from igniter delivery tube 35 is sealably blocked by intermediate annular seal 154. An igniter nozzle 37 extends from the igniter delivery tube 35 through a seal 34 and terminates close to an igniter pan 38 which encircles the nozzle 9 near its end 114.

Figure 6:
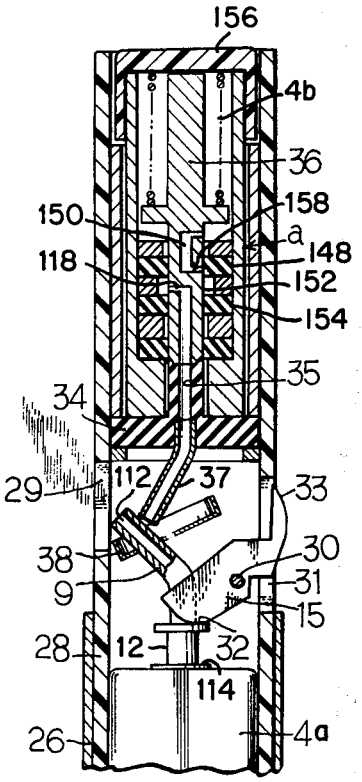
FIG. 6 is a fragmentary sectional view showing a delivery of self-burning gas in the third embodiment.

Referring now to FIG. 6, the removeable cap 27 has been fully removed. The actuating portion 33 of the lever 15 is thus enabled to rotate outward through the actuator window 31. This removes the downward force on the tube 12 previously applied by cam portion 32. The tube 12 moves upward under the influence of internal springs (not shown) thus opening valve 144 and allowing a jet of fuel to issue through channel 112 and emerge through window 29 to the outside.

To ignite the fuel issuing from channel 112, the actuating button 156 is depressed. Upper annular seal 148, intermediate annular seal 154, and the annular chamber 152 are moved downward relative to the shaft 36. The lower leg 158 of the U-shaped channel 150 is sealingly enclosed by the upper annular seal 148. The intermediate annular seal 154, in moving downward, has opened the lateral channel 118 to the igniter material isolated in the annular chamber 152. The igniter material thereupon passed through igniter delivery tube 35 and igniter nozzle 37 and drops into igniter pan 38. The igniter material ignites spontaneously upon contact with the atmosphere, thus igniting the nearby jet of fuel issuing from the nozzle 9. The resulting flame is projected through the window 29. To extinguish the flame, the removeable cap 27 is replaced. This forces the actuating portion 33 of the lever 15 into the actuator window 31 thereby returning the lever 15 to its counterclockwise position and thus cuts off valve 144. With the removeable cap 27 in place, the actuating button 156 cannot be accidentally depressed. If the removeable cap 27 is partly removed to release the lever 15, some unignited fuel will be discharged, but the igniter fluid will remain protected since access to the actuating button 156 is denied until the removeable cap is completely removed.

It will be understood that the claims are intended to cover all changes and modifications of the preferred embodiments of the invention, herein chosen for the purpose of illustration which do not constitute departures from the spirit and scope of the invention.

What is claimed is:

1. A cigarette lighter comprising:

(a) a case;
(b) an openable cap for said case;
(c) at least one fluid container in said case;
(d) said at least one fluid container containing a spontaneously ignitable substance which spontaneously ignites upon exposure to air;
(e) said at least one container containing a fuel which vaporizes at atmospheric pressure;
(f) constant quantity valve means for dispensing a fixed maximum quantity of at least said spontaneously ignitable substance when it is actuated;
(g) means for actuating said constant quantity valve means;
(h) said means for actuating requiring a physical act of the user;
(i) means for blocking operation of said means for actuating when said cap is closed, said means for blocking being further adapted to permit operation of said means for actuating when said cap is opened;
(j) at least one nozzle;
(k) valve means for controlling the supplying of said fuel to said at least one nozzle;
(l) means for exposing said spontaneously ignitable substance to the atmosphere in a location where it ignites said fuel at said nozzle;
(m) said spontaneously ignitable substance and said fuel being mixed in said at least one container; and
(n) said constant quantity valve means dispensing a fixed maximum quantity of the mixture to said at least one nozzle.

2. A cigarette lighter comprising:

(a) a case;
(b) an openable cap for said case;
(c) at least one fluid container in said case;
(d) said at least one fluid container containing a spontaneously ignitable substance which spontaneously ignites upon exposure to air;
(e) said at least one container containing a fuel which vaporizes at atmospheric pressure;
(f) constant quantity valve means for dispensing a fixed maximum quantity of at least said spontaneously ignitable substance when it is actuated;
(g) means for actuating said constant quantity valve means;
(h) said means for actuating requiring a physical act of the user;
(i) means for blocking operation of said means for actuating when said cap is closed, said means for blocking being further adapted to permit operation of said means for actuating when said cap is opened;
(j) at least one nozzle;
(k) valve means for controlling the supplying of said fuel to said at least one nozzle;
(l) means for exposing said spontaneously ignitable substance to the atmosphere in a location where it ignites said fuel at said nozzle;
(m) said at least one fluid container being first and second fluid containers;
(n) said first fluid container containing said fuel;
(o) said second container containing said spontaneously ignitable substance;
(p) said at least one nozzle being first and second nozzles having outlets;
(q) said first nozzle being supplied by said valve means;
(r) said second nozzle being supplied said spontaneously ignitable substance by said constant quantity valve means;
(s) the outlets of said first and second nozzles being close together whereby ignition of said spontaneously ignitable substance kindles said fuel;
(t) a pan adjacent the outlet of said first nozzle; and
(u) said second nozzle being operative to deposit said spontaneously ignitable substance in said pan.

3. A cigarette lighter comprising:

(a) a case;
(b) an openable cap for said case;
(c) at least one fluid container in said case;
(d) said at least one fluid container containing a spontaneously ignitable substance which spontaneously ignites upon exposure to air;
(e) said at least one container containing a fuel which vaporizes at atmospheric pressure;
(f) constant quantity valve means for dispensing a fixed maximum quantity of at least said spontaneously ignitable substance when it is actuated;
(g) means for actuating said constant quantity valve means;

(h) said means for actuating requiring a physical act of the user;
(i) means for blocking operation of said means for actuating when said cap is closed, said means for blocking being further adapted to permit operation of said means for actuating when said cap is opened;
(j) at least one nozzle;
(k) valve means for controlling the supplying of said fuel to said at least one nozzle;
(l) means for exposing said spontaneously ignitable substance to the atmosphere in a location where it ignites said fuel at said nozzle;
(m) said openable cap is hinged to said case;
(n) said actuating means being a lever pivotably attached in said case;
(o) said lever being operatively connected to said constant quantity valve;
(p) said means for blocking holding said lever immovable when said cap is closed; and
(q) and means accessible from the exterior of said case for pivoting said lever when said cap is open.

4. A cigarette lighter comprising:
(a) a case;
(b) an openable cap for said case;
(c) at least one fluid container in said case;
(d) said at least one fluid container containing a spontaneously ignitable substance which spontaneously ignites upon exposure to air;
(e) said at least one container containing a fuel which vaporizes at atmospheric pressure;
(f) constant quantity valve means for dispensing a fixed maximum quantity of at least said spontaneously ignitable substance when it is actuated;
(g) means for actuating said constant quantity valve means;
(h) said means for actuating requiring a physical act of the user;
(i) means for blocking operation of said means for actuating when said cap is closed, said means for blocking being further adapted to permit operation of said means for actuating when said cap is opened;
(j) at least one nozzle;
(k) valve means for controlling the supplying of said fuel to said at least one nozzle;
(l) means for exposing said spontaneously ignitable substance to the atmosphere in a location where it ignites said fuel at said nozzle;
(m) said at least one fluid container being first and second fluid containers;
(n) said first fluid container containing said fuel;
(o) said second container containing said spontaneously ignitable substance;
(p) said at least one nozzle being first and second nozzles having outlets;
(q) said first nozzle being supplied fuel by said valve means;
(r) said second nozzle being supplied said spontaneously ignitable substance by said constant quantity valve means;
(s) the outlets of said first and second nozzles being close together whereby ignition of said spontaneously ignitable substance kindles said fuel;
(t) said outlets are adjacent, and substantially parallel;
(u) said openable cap being hinged to said case;
(v) resilient material inside said cap; and
(w) said resilient material sealably covering the outlets of said first and second nozzles when said cap is closed.

5. A cigarette lighter comprising:
(a) a case;
(b) an openable cap for said case;
(c) at least one fluid container in said case;
(d) said at least one fluid container containing a spontaneously ignitable substance which spontaneously ignites upon exposure to air;
(e) said at least one container containing a fuel which vaporizes at atmospheric pressure;
(f) constant quantity valve means for dispensing a fixed maximum quantity of at least said spontaneously ignitable substance when it is actuated;
(g) means for actuating said constant quantity valve means;
(h) said means for actuating requiring a physical act of the user;
(i) means for blocking operation of said means for actuating when said cap is closed, said means for blocking being further adapted to permit operation of said means for actuating when said cap is opened;
(j) at least one nozzle;
(k) valve means for controlling the supplying of said fuel to said at least one nozzle;
(l) means for exposing said spontaneously ignitable substance to the atmosphere in a location where it ignites said fuel at said nozzle;
(m) said openable cap being completely removeable;
(n) a lever pivotably attached in said case having a cam end and an actuating end;
(o) said actuating end abutting the inside of said openable cap when said cap is closed whereby said lever is held in a first position;
(p) said cam end abutting and closing said valve when said lever is in said first position;
(q) said lever being pivoted to a second position when said openable cap is removed;
(r) said cam end opening said valve means when said lever is in its second position; and
(s) said means for actuating being covered by said openable cap until said openable cap is fully removed.

6. Apparatus in claim 5 further comprising:
(a) said case being elongated and having first and second ends;
(b) a fuel tank in one end of said case;
(c) an igniter tank for said spontaneously ignitable fluid in the second end of said case;
(d) said at least one nozzle being intermediate said fuel tank and said igniter tank;
(e) a window in said case adjacent said at least one nozzle;
(f) said at least one nozzle having its axis pointed toward said window; and
(g) said means for actuating being located at said second end.

7. Apparatus in claim 6 further comprising:
(a) a pan at least partially encircling said nozzle adjacent the end thereof;
(b) an igniter nozzle;
(c) said igniter nozzle being supplied with said spontaneously ignitable substance by said constant quantity valve; and
(d) said igniter nozzle being operative to deposit said spontaneously ignitable substance in said pan.

* * * * *